US008195079B2

(12) United States Patent
Tanaka et al.

(10) Patent No.: US 8,195,079 B2
(45) Date of Patent: Jun. 5, 2012

(54) COLLECTION DEVICE AND IMAGE FORMING APPARATUS

(75) Inventors: Mihoko Tanaka, Ebina (JP); Tomoya Ichikawa, Ebina (JP); Satoshi Shigezaki, Ebina (JP); Tatsuya Soga, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 399 days.

(21) Appl. No.: 12/536,934

(22) Filed: Aug. 6, 2009

(65) Prior Publication Data

US 2010/0239341 A1 Sep. 23, 2010

(30) Foreign Application Priority Data

Mar. 19, 2009 (JP) ..... 2009-068613

(51) Int. Cl.
*G03G 21/12* (2006.01)

(52) U.S. Cl. ..... 399/360; 399/120

(58) Field of Classification Search ..... 399/107, 399/119, 120, 343, 358, 360
See application file for complete search history.

(56) References Cited

U.S. PATENT DOCUMENTS 7,356,301 B2 * 4/2008 Onodera ..... 399/358
7,606,523 B2 * 10/2009 Kubo ..... 399/360

FOREIGN PATENT DOCUMENTS

JP 2001-209286 8/2001

* cited by examiner

*Primary Examiner* — Hoan Tran
(74) *Attorney, Agent, or Firm* — Morgan, Lewis & Bockius LLP

(57) ABSTRACT

A collection device includes: a collection container that collects output material; a storage box that is opened upward to store a lower part of the collection container; and a support member that is fixed to a housing and supports the storage box so that the collection container is stored in the storage box and is freely drawn to the outside of the housing. The collection container includes a handle located frontward in a pulling direction and at an upper part of the collection container. The storage box includes a notch formed in a rear surface in the pulling direction. When the handle of the collection container is pressed backward in the pulling direction, a part of the collection container, which part is located backward in the pulling direction, protrudes from the storage box through the notch, so that the collection container inclines backward in the pulling direction.

8 Claims, 7 Drawing Sheets

COLLECTION DEVICE AND IMAGE FORMING APPARATUS

CROSS-REFERENCE TO RELATED APPLICATION

This application is based on and claims priority under 35 USC 119 from Japanese Patent Application No. 2009-068613, filed Mar. 19, 2009.

BACKGROUND (i) Technical Field

The present invention relates to a collection device and an image forming apparatus.

(ii) Related Art

For example, a collection container is placed in an apparatus housing of an image forming apparatus that forms an image using powder toner. In this collection container, unnecessary waste toner that has not been used in forming the image is stored. When the collection container is filled with the waste toner, the collection container is taken out from the apparatus housing and an empty collection container is placed therein.

SUMMARY

According to an aspect of the invention, a collection device includes:

a collection container that collects output material;

a storage box that is opened upward to store a lower part of the collection container; and a support member that is fixed to a housing and supports the storage box, the support member enabling the storage box in which the collection container is stored to be housed in the housing and to be freely drawn to the outside of the housing, wherein the collection container includes a handle located frontward in a pulling direction and at an upper part of the collection container, and the storage box includes a notch formed in a rear surface in the pulling direction, the notch allowing a part of the collection container, which part is located backward in the pulling direction, to protrude from the storage box, thereby permitting the collection container to incline backward in the pulling direction, when the handle of the collection container stored in the storage box is pressed backward in the pulling direction.

BRIEF DESCRIPTION OF THE DRAWINGS

Exemplary embodiments of the present invention will be described in detail based on the following figures, wherein.

DETAILED DESCRIPTION

An exemplary embodiment of the invention will be described below.

Figure 1:
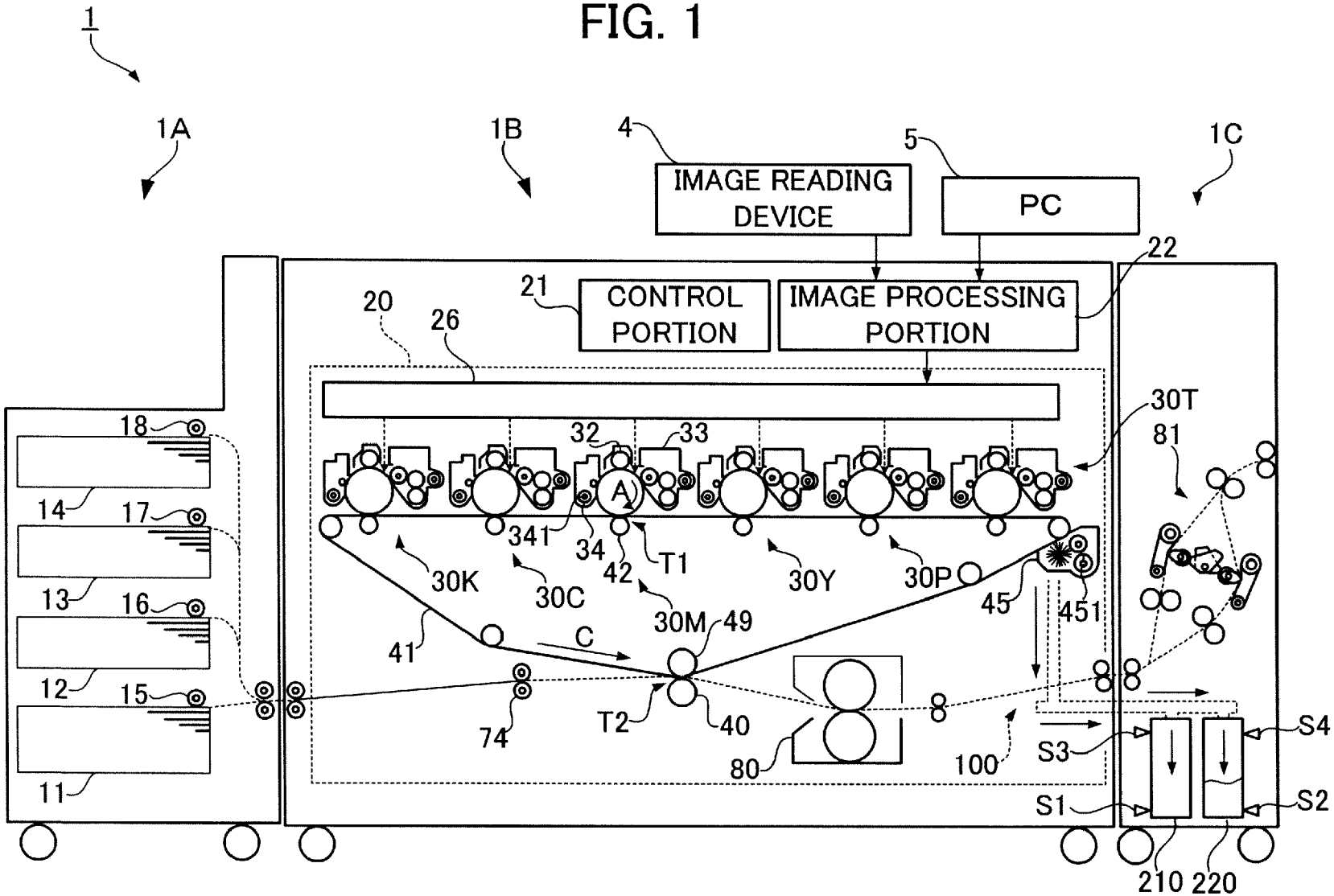
FIG. 1 illustrates an example of an image forming apparatus according to an exemplary embodiment of the invention.

FIG. 1 illustrates an example of an image forming apparatus according to an exemplary embodiment of the invention.

An image forming apparatus 1 of the exemplary embodiment includes a sheet feeding unit 1A, an image forming unit 1B, and a sheet outputting unit 1C.

The sheet feeding unit 1A includes first to fourth sheet storage portions 11 to 14 in which sheets are stored. The image forming apparatus 1 also includes delivery rollers 15 to 18 that are provided for the first sheet to fourth storage portions 11 to 14 to deliver the sheets stored in the sheet storage portions to conveyance paths connected to the image forming unit 1B.

The image forming unit 1B is a so-called tandem type image forming unit. The image forming unit 1B includes an image forming portion 20, a control portion 21, and an image processing portion 22. The image forming portion 20 forms an image on the sheet. The control portion 21 controls the image forming portion 20. The image processing portion 22 is connected to, for example, an image reading device 4 or a personal computer (PC) 5, and performs image processing to image data received from the image reading device 4 or PC 5.

The image forming portion 20 includes six image forming engines 30T, 30P, 30Y, 30M, 30C, and 30K (hereinafter sometimes simply referred to as "image forming engine 30") that are arranged in parallel at a constant intervals. Each image forming engine 30 includes a photosensitive drum 31, a charging roller 32, a development device 33, and a drum cleaner 34. An electrostatic latent image is formed on the photosensitive drum 31 while the photosensitive drum 31 is rotated in a direction of an arrow A. The charging roller 32 evenly charges a surface of the photosensitive drum 31. The development device 33 develops the electrostatic latent image formed on the photosensitive drum 31. The drum cleaner 34 removes un-transferred toner from the surface of the photosensitive drum 31. Further, a laser exposure device 26 is provided to expose the photosensitive drum 31 of each of the image forming engines 30T, 30P, 30Y, 30M, 30C, and 30K by scanning with a laser beam.

The image forming engine 30 has a substantially similar configuration except for a color or a type of toner stored in the development device 33. Yellow (Y), magenta (M), cyan (C), and black (K) toner images are formed in the image forming engines 30Y, 30M, 30C, and 30K, respectively.

Sometimes it is desired to form an image on a sheet using a special color hardly expressed by the yellow, magenta, cyan, and black colors that are of process colors. For example, sometimes it is desired to form an image on a sheet using corporate color toner dedicated to a specific user, braille foamable toner, fluorescent color toner, gloss improving toner, ferromagnetic toner, or invisible toner having sensitivity in an infrared region. Therefore, in the image forming unit 1B of the exemplary embodiment, the image forming engines 30T and 30P that form an image using the special color are provided in addition to the image forming engines 30Y, 30M, 30C, and 30K that form the image using the process color or black toner.

The image forming portion 20 includes an intermediate transfer belt 41, a primary transfer roller 42, a secondary transfer roller 40, a belt cleaner 45, and a fixing device 80. The color toner images formed on the photosensitive drums 31 of the image forming engines 30 are multiple-transferred to the intermediate transfer belt 41. The primary transfer roller 42 sequentially transfers (primary-transfers) color toner images of the image forming engines 30 to the intermediate transfer belt 41 at a primary transfer portion T1. The secondary transfer roller 40 collectively secondary-transfers the superimposed toner image transferred onto the intermediate transfer belt 41 to a sheet at a secondary transfer portion T2. The belt cleaner 45 removes un-transferred toner in the surface of the intermediate transfer belt 41. The fixing device 80 fixes the secondary-transferred image onto the sheet.

The image forming portion 20 performs an image forming operation based on a control signal supplied from the control portion 21. The image processing portion 22 applies the image processing to the image data fed from the image reading device 4 or PC 5 and supplies the image data to the laser exposure device 26. For example, in the magenta (M) image forming engine 30M, the charging roller 32 evenly charges the surface of the photosensitive drum 31 to be at a predetermined potential, and the laser exposure device 26 performs scanning exposure with the laser beam that is modulated by the image data obtained from the image processing portion 22, thereby forming the electrostatic latent image on the photosensitive drum 31. The development device 33 develops the electrostatic latent image to form the magenta toner image on the photosensitive drum 31. Similarly, the yellow, cyan, and black toner images are formed in the image forming units 30Y, 30C, and 30K, and the toner images having the special color and the like are formed in the image forming units 30T and 30P.

The primary transfer rollers 42 sequentially electrostatically primary-transfer the color toner images formed in the image forming units 30 onto the intermediate transfer belt 41 rotated in a direction of an arrow C shown in FIG. 1, thereby forming the superimposed toner images on the intermediate transfer belt 41.

Meanwhile, the drum cleaner 34 provided downstream from the primary transfer roller 42 removes the un-transferred toner remaining on the photosensitive drum 31 in the primary transfer. The drum cleaner 34 includes a conveying member 341. The conveying member 341 is provided along an axial direction of the photosensitive drum 31, and conveys the removed un-transferred toner to the backside of the image forming unit 1B. A conveying mechanism 100 is provided on the backside of the image forming unit 1B. The conveying mechanism 100 conveys, to a first collection container 210 or a second collection container 220, waste powders that includes the un-transferred toner conveyed to the backside of the image forming unit 1B by the conveying member 341. The first collection container 210 and the second collection container 220 are detachably attached to the sheet outputting unit 1C.

At this point, the two collection containers that are of the first collection container 210 and second collection container 220 are provided in the exemplary embodiment. Therefore, for example, when one of the collection containers is filled with the un-transferred toner, the un-transferred toner can be conveyed to the other collection container to continuously perform the image forming operation. Also, for instance, as compared with the storage of the un-transferred toner in one large-capacity collection container, the weight of the collection container filled with un-transferred toner when detached from the sheet outputting unit 1C can be reduced.

A first sensor S1, a second sensor S2, a third sensor S3, and a fourth sensor S4 and a forth sensor S4 are provided in the exemplary embodiment. The first sensor S1 senses the first collection container 210, and the second sensor S2 senses the second collection container 220. The third sensor S3 supplies a predetermined signal when the un-transferred toner reaches a top part of the first collection container 210, that is, when the first collection container 210 is filled with the un-transferred toner. The fourth sensor S4 supplies a predetermined signal when the un-transferred toner reaches a top part of the second collection container 220, that is, when the second collection container 220 is filled with the un-transferred toner.

In the exemplary embodiment, the first collection container 210 and the second collection container 220 are provided in the sheet outputting unit 1C. Alternatively, the first collection container 210 and the second collection container 220 may be provided in the image forming unit 1B.

On the other hand, the superimposed toner images formed on the intermediate transfer belt 41 are conveyed toward the secondary transfer portion T2 as the intermediate transfer belt 41 is moved. The secondary transfer roller 40 and the backup roller 49 are provided in the secondary transfer portion T2. The delivery roller 15 takes out a sheet from the first sheet storage portion 11, and the sheet is conveyed to the position of a registration roller 74 through a conveying path.

When the superimposed toner images are conveyed to the secondary transfer portion T2, the sheet is supplied from the registration roller 74 to the secondary transfer portion T2 in synchronization with the conveyance of the superimposed toner images to the secondary transfer portion T2. In the secondary transfer portion T2, the superimposed toner images are collectively electrostatically secondary-transferred to the sheet by action of a transfer electric field formed between the secondary transfer roller 40 and the backup roller 49.

Then the sheet to which the superimposed toner images are electrostatically transferred is peeled from the intermediate transfer belt 41 and conveyed to the fixing device 80. The fixing device 80 applies a fixing process with heat and pressure to the un-fixed toner image on the sheet conveyed to the fixing device 80, thereby fixing the toner image to the sheet. The sheet in which the fixed image is formed is conveyed to a sheet output stacking portion (not illustrated) through a curl correction portion 81 provided in the sheet outputting unit 1C.

After the secondary transfer, the belt cleaner 45 removes the un-transferred toner remaining on the surface of the intermediate transfer belt 41. The belt cleaner 45 is disposed so as to be in contact with the intermediate transfer belt 41. The belt cleaner 45 includes a conveying member 451. The conveying member 451 is provided to convey the removed un-transferred toner in a direction from the front surface side of the image forming unit 1B toward the backside of the image forming unit 1B. The conveying mechanism 100 conveys the un-transferred toner, conveyed to the backside of the image forming unit 1B by the conveying member 451, to the first collection container 210 or the second collection container 220. Hereinafter the un-transferred toner conveyed to the conveying mechanism 100 from the drum cleaner 34 and belt cleaner 45 is referred to as waste toner.

Subsequently, the conveying mechanism 100 will be described in detail.

Figure 2:
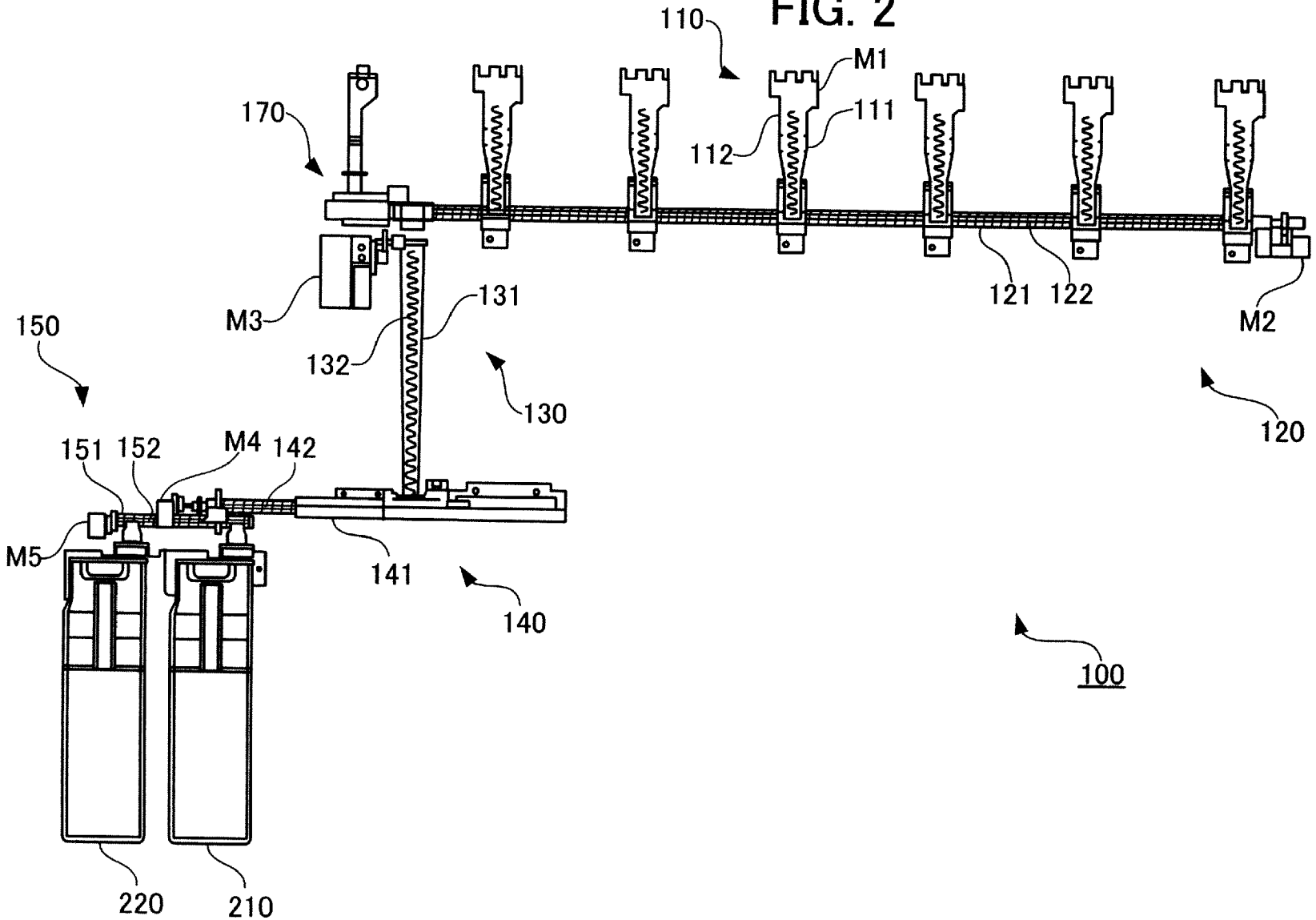
FIG. 2 illustrates a conveying mechanism when viewed from the backside of the image forming apparatus.

FIG. 2 illustrates the conveying mechanism 100 when viewed from the backside of the image forming apparatus 1.

As illustrated in FIG. 2, the conveying mechanism 100 is provided to correspond to each image forming unit 30, and includes a first conveying mechanism 110 that conveys the waste toner from the drum cleaner 34. The conveying mechanism 100 also includes an output portion 170 to which the waste toner is output from the belt cleaner 45. The conveying mechanism 100 also includes a second conveying mechanism 120, a third conveying mechanism 130, a fourth conveying mechanism 140, and a fifth conveying mechanism 150. The second conveying mechanism 120 conveys the waste toner conveyed by the first conveying mechanism 110 and the waste toner output from the output portion 170. The third conveying mechanism 130 conveys the waste toner conveyed by the second conveying mechanism 120. The fourth conveying mechanism 140 conveys the waste toner conveyed by the third conveying mechanism 130. The fifth conveying mechanism 150 conveys the waste toner, conveyed by the fourth conveying mechanism 140, to the first collection container 210 or the second collection container 220.

The first conveying mechanism 110 includes a tubular member 111, a coil spring 112, and a first motor M1. The tubular member 111 forms a conveying path for the waste toner that is conveyed by the conveying member 341 (see FIG. 1) provided in the drum cleaner 34. The coil spring 112 is provided in the tubular member 111 and vertically moved to break the waste toner adhering to an inner wall surface of the tubular member 111. The first motor M1 vertically moves the coil spring 112 while rotating the conveying member 341.

The waste toner conveyed by the conveying member 341 falls in the tubular member 111.

The coil spring 112 having a spiral (coiled) shape is made of a wire material. The waste toner can pass through a central part of the coil spring 112, and the coil spring 112 has the shape that permits the waste toner to fall in the tubular member 111. The coil spring 112 is vertically moved in the tubular member 111 by the first motor M1, so as to break the solid waste toner in the tubular member 111 and remove the waste toner from the inner wall of the tubular member 111.

The second conveying mechanism 120 includes a tubular member 121. The tubular member 121 is disposed while extended in a horizontal direction in which the image forming engines 30T, 30P, 30Y, 30M, 30C, and 30K are arrayed, and the tubular member 121 is connected to the tubular member 111 and output portion 170 to form the conveying path for the waste toner. The second conveying mechanism 120 also includes a conveying member 122 and a second motor M2. The conveying member 122 is disposed in the tubular member 121 to convey the waste toner conveyed from each first conveying mechanism 110 and the waste toner output from the output portion 170. The second motor M2 rotates the conveying member 122. When the second motor M2 is rotated, the conveying member 122 conveys the waste toner in the tubular member 121 toward the third conveying mechanism 130.

The third conveying mechanism 130 includes a tubular member 131. The tubular member 131 is vertically disposed and connected to the tubular member 121 to form the conveying path for the waste toner. The third conveying mechanism 130 includes a coil spring 132 and a third motor M3. The coil spring 132 is provided in the tubular member 131 so as to be vertically movable. The third motor M3 vertically moves the coil spring 132.

The waste toner conveyed by the second conveying mechanism 120 falls in the tubular member 131.

As with the coil spring 112, the coil spring 132 having the spiral (coiled) shape is made of the wire material. The waste toner can pass through the central part of the coil spring 132, and the coil spring 132 has the shape that permits the waste toner to fall in the tubular member 131. The coil spring 132 is vertically moved in the tubular member 131 by the third motor M3, and breaks the solid waste toner in the tubular member 131 and remove the waste toner from the inner wall of the tubular member 131.

The fourth conveying mechanism 140 includes a tubular member 141. The tubular member 141 is horizontally disposed to form the conveying path for the waste toner. The fourth conveying mechanism 140 also includes a conveying member 142 and a fourth motor M4. The conveying member 142 is disposed in the tubular member 141 to convey the waste toner from the third conveying mechanism 130. The fourth motor M4 rotates the conveying member 142.

The fifth conveying mechanism 150 includes a tubular member 151. The tubular member 151 is disposed in parallel with the tubular member 141 while disposed below the tubular member 141 of the fourth conveying mechanism 140. The tubular member 151 forms the conveying path for the waste toner. The fifth conveying mechanism 150 also includes a conveying member 152 and a fifth motor M5. The conveying member 152 is disposed in the tubular member 151, and the conveying member 152 conveys the waste toner from the fourth conveying mechanism 140. The fifth motor M5 rotates the conveying member 152.

The fourth conveying mechanism 140 accepts the waste toner conveyed by the third conveying mechanism 130, and the fourth motor M4 rotates the conveying member 142 to deliver the waste toner to the fifth conveying mechanism 150. The fifth conveying mechanism 150 conveys the waste toner from the fourth conveying mechanism 140 to the first collection container 210 or second collection container 220 to store the waste toner in the first and second collection containers 210 and 220. At this point, the fifth motor M5 provided in the fifth conveying mechanism 150 can normally and reversely be rotated. In the fifth conveying mechanism 150, when the conveying member 152 is normally rotated by the normal rotation of the fifth motor M5, the waste toner sent from the fourth conveying mechanism 140 is conveyed to and stored in the first collection container 210. When the first collection container 210 is filled with the waste toner, the conveying member 152 is reversely rotated in turn by the reverse rotation of the fifth motor M5, and the waste toner sent from the fourth conveying mechanism 140 is stored in the second collection container 220. When the second collection container 220 is filled with the waste toner, the fifth motor M5 is normally rotated again. The normal rotation and the reverse rotation are alternately repeated.

The collection container (first collection container 210 or second collection container 220) filled with the waste toner is drawn from the housing of the sheet outputting unit IC (see FIG. 1), and the empty collection container, which is empty, is attached to the housing again.

A collection container support structure and a method of drawing the collection container from the housing of the sheet outputting unit will be described. Hereinafter sometimes the collection container 210 may represent both the first and second collection container 210.

Figure 3:
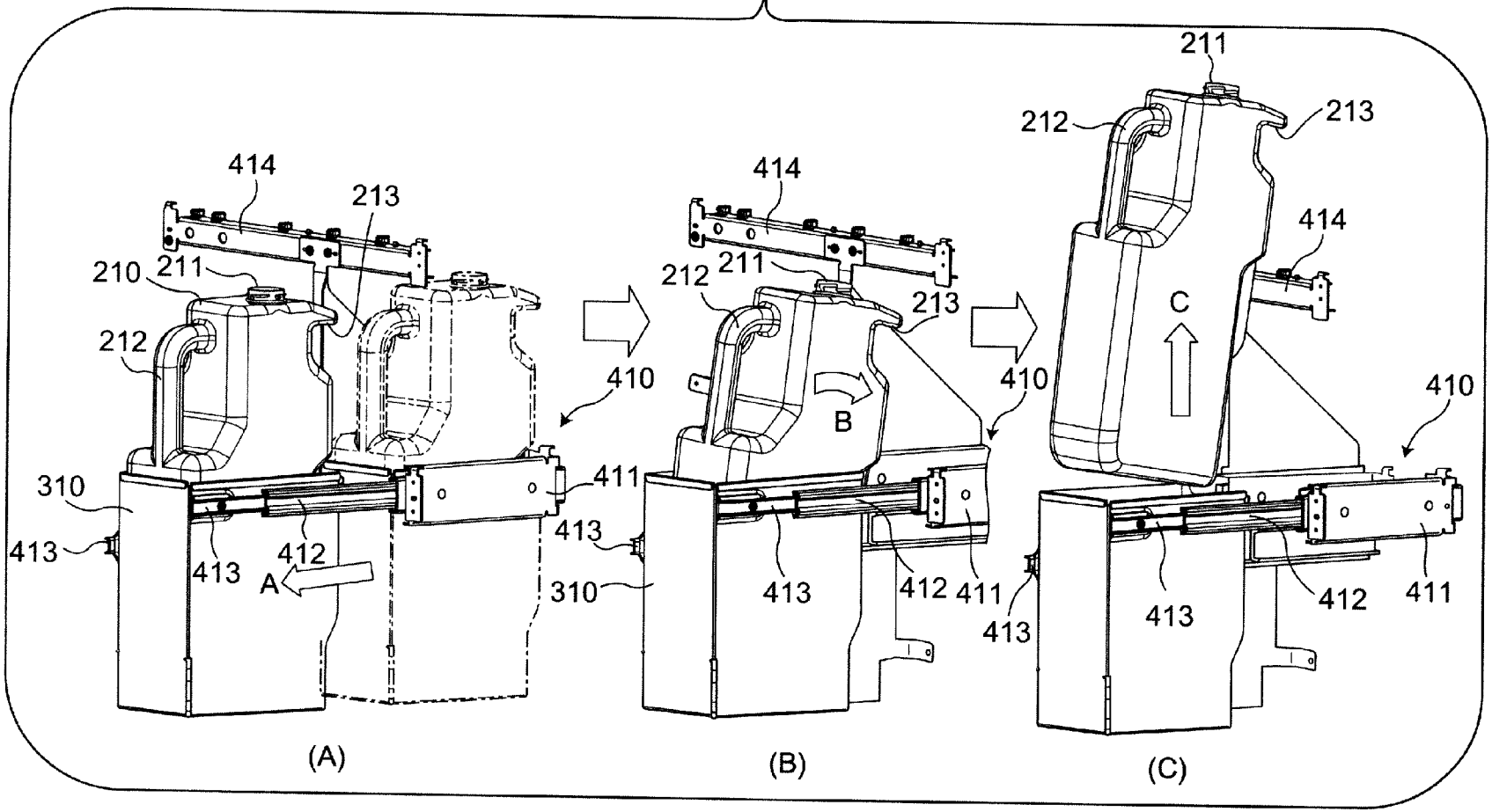
FIG. 3 illustrates an outline of a method of taking out a collection container.

FIG. 3 illustrates an outline of the method of taking out the collection container.

A lower half of the collection container 210 is stored in a storage box 310. A support member 410 supports the storage box 310. The support member 410 includes a fixed arm 411, a first movable arm 412, and a second movable arm 413. The fixed arm 411 is fixed to the apparatus main body when the storage box 310 is drawn to the outside. The first movable arm 412 and the second movable arm 413 are movable relative to the fixed arm 411 when the storage box 310 is drawn to the outside. The first movable arm 412 and the second movable arm 413 are drawn in synchronization with the operation for drawing the storage box 310, and the first movable arm 412 and the second movable arm 413 support the storage box 310. The first movable arm 412 is stored while being able to be freely projected from the fixed arm 411, and the second movable arm 413 is stored while being able to be freely projected from the first movable arm 412. The pair of support members 410 is provided on both sides of each one collection container 310. The fixed arm 411 of the outer support member 410 in the pair of support members 410 is directly fixed to the housing of the sheet outputting unit, and the fixed arm 411 of the inner support member 410 is fixed to the housing of the sheet outputting unit via a support arm 414.

The collection container 210 includes an acceptance port 211 that is provided in the top of the collection container 210 to accept the waste toner, and the waste toner conveyed by the fifth conveying mechanism 150 (see FIG. 2) is stored in the collection container 210 through the acceptance port 211. The collection container 210 includes a handle 212. The handle 212 is provided at a front portion in a pulling direction indicated by an arrow A in part (A) of FIG. 3 and at an upper part of the collection container 210.

When the collection container 210 is drawn from the housing of the sheet outputting unit, as illustrated in part (A) of FIG. 3, the handle 212 of the collection container 210 stored in the housing (state indicated by an alternate long and short dash line of part (A) of FIG. 3) is held by a hand and drawn in the pulling direction (arrow A). As a result, the first and second movable arms 412 and 413 of the support member 410 are extended, and the collection container 210 is drawn to the outside of the housing while stored in the storage box 310.

After the collection container 210 is drawn to the outside of the housing while stored in the storage box 310, as illustrated in part (B) of FIG. 3, the handle 212 of the collection container 210 is pushed backward in the pulling direction to incline the collection container 210 in a direction of an arrow B. When the collection container 210 is properly inclined, the collection container 210 and the storage box 310 interfere with each other to prevent the further inclination of the collection container 210. As illustrated in part (C) of FIG. 3, the inclined collection container 210 is pulled upward while the handle 212 is held by the hand, thereby taking out the collection container 210 from the storage box 310. The collection container 210 includes an auxiliary part 213. The auxiliary part 213 is provided at the upper part of the collection container 210 and at the rear part in the pulling direction. When the weight of the collection container 210 is increased because the collection container 210 is fully filled with the waste toner, the auxiliary part 213 is held by the other hand so that the collection container 210 is lifted by both hands.

In this way, the collection container 210 can directly be lifted and taken out from the housing while the handle 212 of the collection container 210 is held, without a necessity to shift the collection container 210 from one hand to the other.

Figure 4:
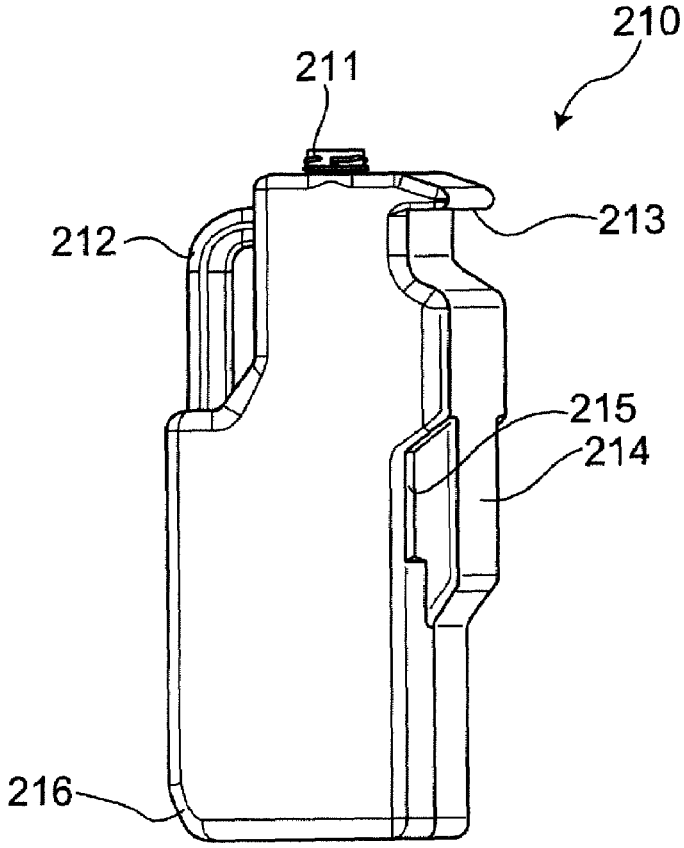
FIG. 4 is a perspective view illustrating a single collection container while the collection container is taken out from a storage box.

FIG. 4 is a perspective view illustrating a single collection container while the collection container is taken out from the storage box.

The collection container 210 includes a protrusion 214, abutment parts 215 located on both sides of the protrusion 214, and a contact part 216 in addition to the acceptance port 211, the handle 212, and the auxiliary part 213. The role of each of the parts 214, 215, and 216 will be described.

Figure 5:
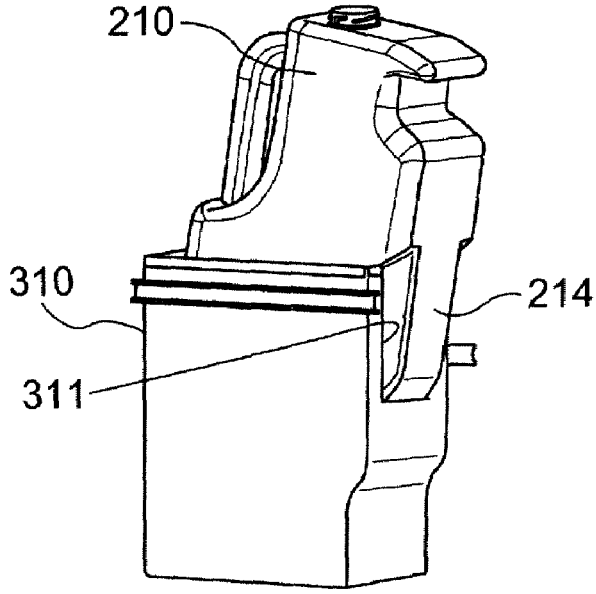
FIG. 5 is a perspective view illustrating the collection container that is inclined while stored in the storage box.

FIG. 5 is a perspective view illustrating the collection container that is inclined while stored in the storage box.

The storage box 310 includes a notch 311 located in the rear surface in the pulling direction. When the handle 212 of the collection container 210 stored in the storage box 310 is pushed backward in the pulling direction, the protrusion 214 of the collection container 210 is protruded from the storage box 310 through the notch 311, which allows the collection container 210 to be inclined backward in the pulling direction. The abutment parts 215 are provided in parts corresponding to the inner wall surfaces on both the sides of the notch 311 of the storage box 310. When the collection container 210 stored in the storage box 310 is inclined backward in the pulling direction, the abutment parts 215 abut on storage-box-side abutment parts to prevent the collection container 210 from inclining further, thereby maintaining the inclination of the collection container 210. When the collection container 210 is lifted while the abutment parts 215 and the storage-box-side abutment parts are in contact with each other, the contact part 216 of the collection container 210 abuts on the storage box on the front surface side in the pulling direction of the storage box to maintain an attitude of the collection container 210. The detailed contact part 216 will be described later.

Figure 6:
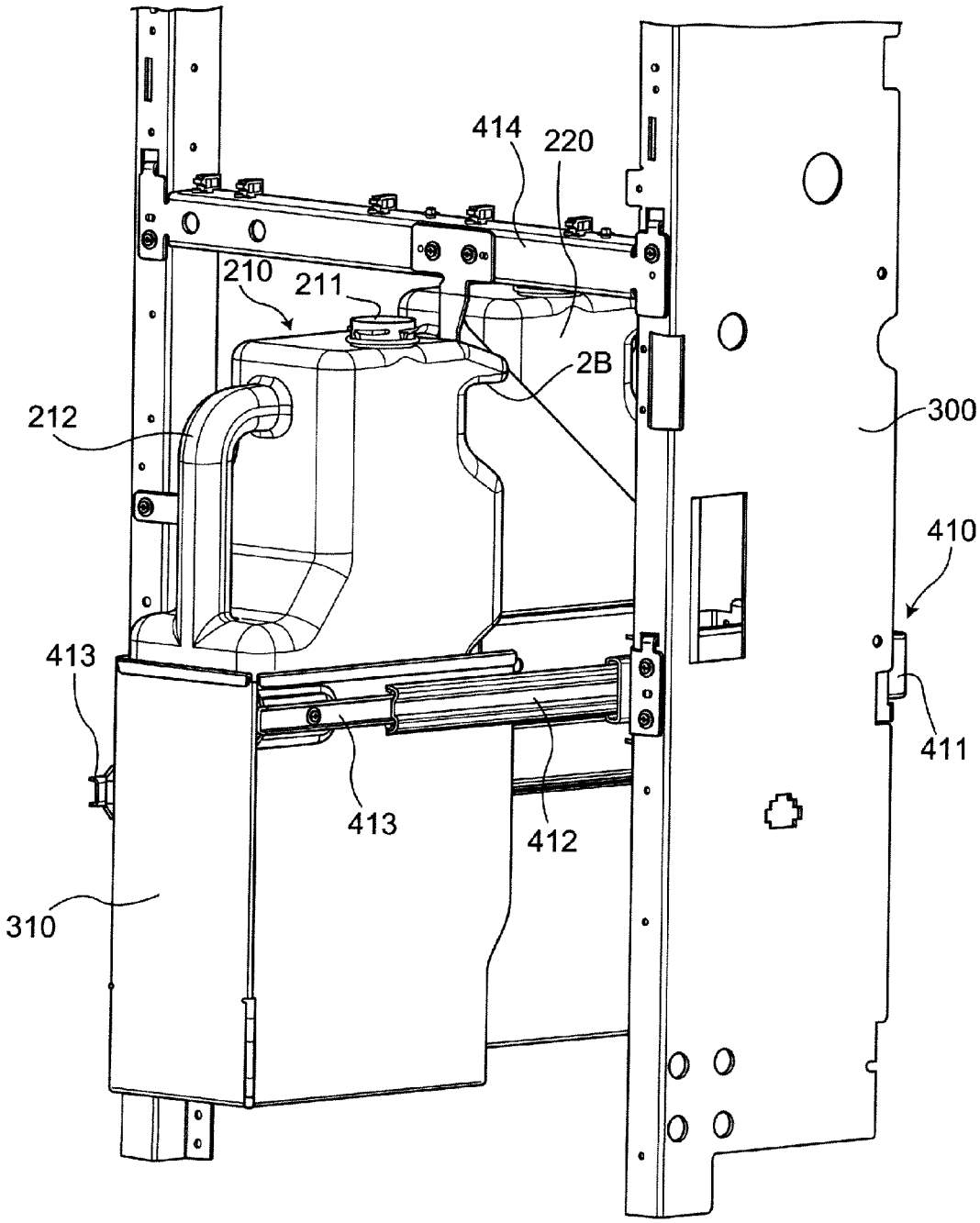
FIG. 6 illustrates a structure in which a support member supporting the storage box is fixed to a housing.

FIG. 6 illustrates a structure in which the support member supporting the storage box is fixed to the housing.

As described above, in the pair of support members 410 supporting the collection container 210 from sides, the fixed arm 411 of the outer support member 410 is directly fixed to the housing 300 of the sheet outputting unit 1C (see FIG. 2), and the fixed arm 411 of the inner support member 410 is fixed to the housing 300 via the support arm 414.

The pair of support members 410 supporting the one storage box 310 from both sides are disposed in different stages, and the inner support member 410 is located lower than the outer support member 410.

The other collection container 220 is partially illustrated in FIG. 6. Of the pair of support members that supports the other storage box in which the collection container 220 is stored from both sides, the inner support member (sandwiched between the collection containers 210 and 220) is disposed immediately above the inner support member that supports the storage box 310 located on the front side of FIG. 6, in order to prevent a useless space that is formed when these two inner support members are horizontally arranged. In this way, the two collection containers 210 and 220 have the same structure and can be taken out and stored in the housing independently of each other.

Figure 7:
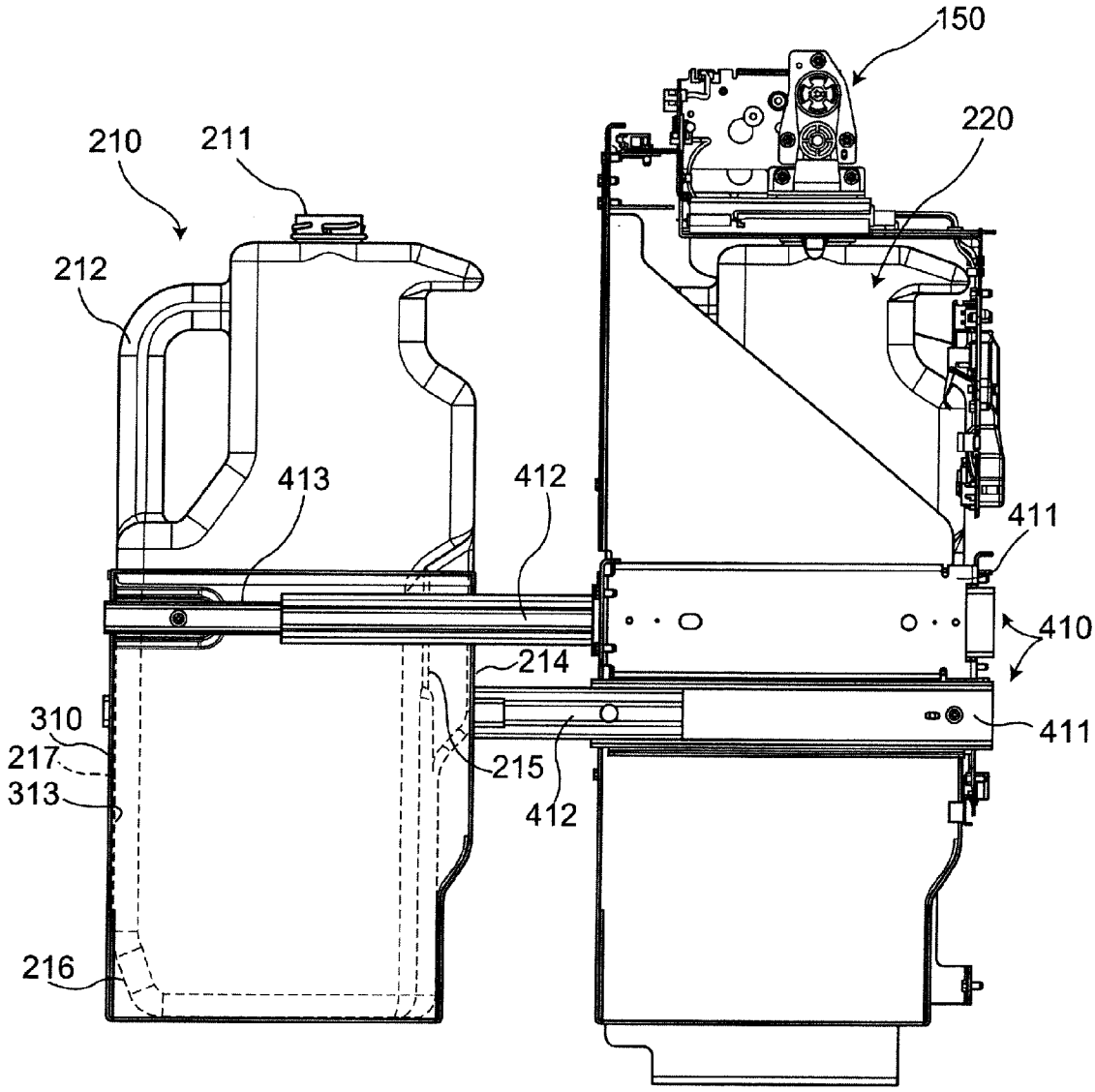
FIG. 7 illustrates a state in which the collection container stored in the storage box is drawn from the housing.
Figure 8:
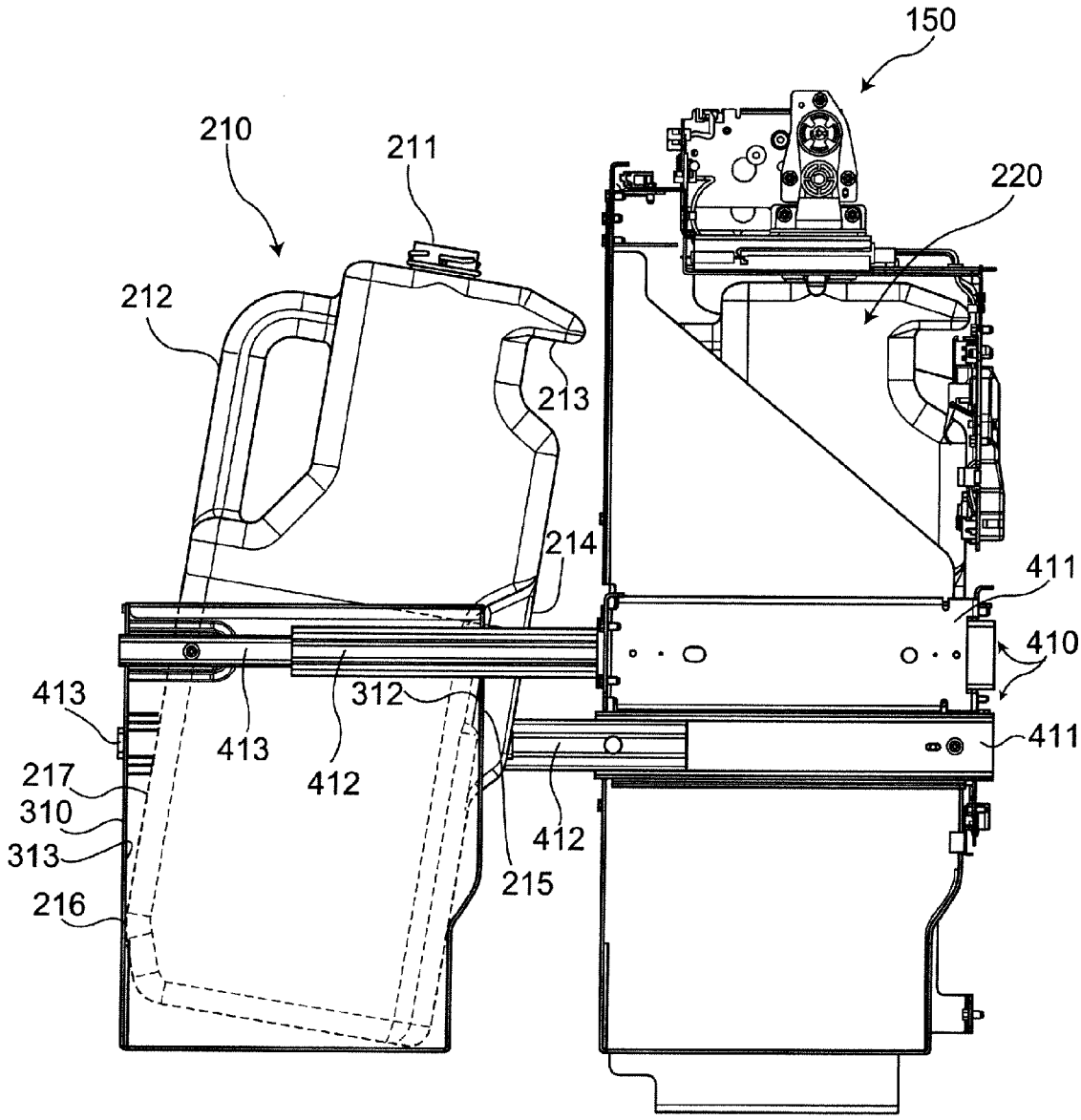
FIG. 8 illustrates a state in which the collection container 210 inclined.

FIG. 7 illustrates the state in which the collection container 210 stored in the storage box 310 is drawn from the housing, and FIG. 8 illustrates the state in which the collection container 210 is inclined.

Although the housing is not illustrated, the part stored in the storage box 310 in the collection container 210 is expressed by a broken line such that a positional relationship between the storage box 310 and the part stored in the storage box 310 in the collection container 210 becomes apparent.

When the collection container 210 is inclined backward in the pulling direction, the collection-container-side abutment part 215 abuts on the storage-box-side abutment part 312, and the collection container 210 is maintained at an angle suitable for lifting the collection container 210. At this point, a wall surface 217 that is part of the collection container 210 and located in a front part in the pulling direction is separated from an inner wall surface 313 of the storage box 310. Only the contact part 216 is in contact with the inner wall surface 313 of the storage box 310.

When the wall surface 217, which is located in the front part in the pulling direction, of the collection container 210 is in contact with the inner wall surface 313 of the storage box 310 over a large area, a large friction force is produced in this contact area when the collection container 210 is pulled up to be removed from the storage box 310, making it difficult to lift the collection container 210. At this point, in the exemplary embodiment, the collection container 210 is inclined, causing only the contact part 216, which is located in the front part in the pulling direction, of the collection container 210 to contact the inner wall surface 313 of the storage box 310, so that the friction force can be reduced to readily pull up the collection container 210.

When the collection container 210 is removed and a new empty collection container 210 is to be attached to the housing, the handle 212 is held and the new collection container 210 is set in the storage box 310 in the reverse procedure to how the collection container 210 is removed and then, the handle 212 is pushed further to store the collection container 210 into the housing together with the storage box 310.

In this way, in the exemplary embodiment, when the collection container 210 is taken out from the housing, the handle 212 is held, and the series of operations for taking out the collection container 210 can be performed without shifting the handle 212 from one hand to the other. Therefore, workability is improved compared with the conventional configuration that requires the handle to be shifted from one hand to the other.

The waste toner collection mechanism incorporated in the image forming apparatus is described in the exemplary embodiment by way of example. However, the invention is not limited to the waste toner, but the invention can widely be applied as a collection device that collects output materials such as output powder.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A collection device comprising:

a collection container that collects output material;

a storage box that is opened upward to store a lower part of the collection container; and a support member that is fixed to a housing and supports the storage box, the support member enabling the storage box in which the collection container is stored to be housed in the housing and to be freely drawn to the outside of the housing, wherein the collection container includes a handle located frontward in a pulling direction and at an upper part of the collection container, and the storage box includes a notch formed in a rear surface in the pulling direction, the notch allowing a part of the collection container, which part is located backward in the pulling direction, to protrude from the storage box, thereby permitting the collection container to incline backward in the pulling direction, when the handle of the collection container stored in the storage box is pressed backward in the pulling direction.

2. The collection device according to claim 1, wherein the storage box and the collection container respectively include a storage-box-side abutment part and a collection-container-side abutment part, the storage-box-side abutment part and the collection-container-side abutment part abutting on each other to prevent further inclination of the collection container when the collection container stored in the storage box is inclined backward in the pulling direction.

3. The collection device according to claim 1, wherein the collection container includes a contact part located at a lower part of the collection container and frontward in the pulling direction, the contact part being in contact with an inner wall of the storage box to keep a wall surface of the collection container, which wall surface is provided frontward in the pulling direction, from contact with the inner wall of the storage box, when the collection container stored in the storage box is inclined backward in the pulling direction.

4. The collection device according to claim 2, wherein the collection container includes a contact part located at a lower part of the collection container and frontward in the pulling direction, the contact part being in contact with an inner wall of the storage box to keep a wall surface of the collection container, which wall surface is provided frontward in the pulling direction, from contact with the inner wall of the storage box, when the collection container stored in the storage box is inclined backward in the pulling direction.

5. The collection device according to claim 1, wherein the collection container includes an auxiliary part that is provided at an upper part of the collection container and backward in the pulling direction, the auxiliary part enabling the container to be lifted by both hands of which one hand holds the handle while the other hand holds the auxiliary part.

6. The collection device according to claim 2, wherein the collection container includes an auxiliary part that is provided at an upper part of the collection container and backward in the pulling direction, the auxiliary part enabling the container to be lifted by both hands of which one hand holds the handle while the other hand holds the auxiliary part.

7. The collection device according to claim 3, wherein the collection container includes an auxiliary part that is provided at an upper part of the collection container and backward in the pulling direction, the auxiliary part enabling the container to be lifted by both hands of which one hand holds the handle while the other hand holds the auxiliary part.

8. An image forming apparatus comprising:

a collection device comprising:

a collection container that collects output material, a storage box that is opened upward to store a lower part of the collection container, and a support member that is fixed to a housing and supports the storage box, the support member enabling the storage box in which the collection container is stored to be housed in the housing and to be freely drawn to the outside of the housing, wherein the collection container includes a handle located frontward in a pulling direction and at an upper part of the collection container, and the storage box includes a notch formed in a rear surface in the pulling direction, the notch allowing a part of the collection container, which part is located backward in the pulling direction, to protrude from the storage box, thereby permitting the collection container to incline backward in the pulling direction, when the handle of the collection container stored in the storage box is pressed backward in the pulling direction;

an image forming portion that outputs powder while forming an image on a recording material; and a powder conveying portion that conveys the powder output by the image forming portion to the inside of the collection container stored in the storage box housed in the housing.

* * * * *